US006723220B2

(12) United States Patent
Speranza

(10) Patent No.: US 6,723,220 B2
(45) Date of Patent: Apr. 20, 2004

(54) PROTONIC RATE LEVEL SENSING DEVICE FOR AN ELECTROLYSIS CELL

(75) Inventor: A. John Speranza, West Hartford, CT (US)

(73) Assignee: Proton Energy Systems, Inc., Rocky Hill, CT (US)

( * ) Notice: Subject to any disclaimer, the term of this patent is extended or adjusted under 35 U.S.C. 154(b) by 158 days.

(21) Appl. No.: 10/127,968

(22) Filed: Apr. 23, 2002

(65) Prior Publication Data

US 2002/0153244 A1 Oct. 24, 2002

Related U.S. Application Data

(60) Provisional application No. 60/286,191, filed on Apr. 24, 2001.

(51) Int. Cl.[7] ..... C25C 3/00; C25B 1/02; C25D 17/00

(52) U.S. Cl. ..... 205/334; 205/637; 204/263; 204/265; 204/266; 204/258

(58) Field of Search ..... 205/334–335, 205/637; 204/258, 263–266, 257

(56) References Cited

U.S. PATENT DOCUMENTS 4,836,903 A * 6/1989 Cawlfield ..... 204/228.3
4,857,158 A * 8/1989 Cawlfield ..... 204/228.3
5,389,264 A 2/1995 Lehmann et al.
6,146,518 A * 11/2000 Fairlie et al. ..... 205/335
6,179,986 B1 1/2001 Swette et al.
6,303,009 B1 * 10/2001 Bossard ..... 204/228.4
6,338,786 B1 * 1/2002 Thorpe et al. ..... 205/628
6,576,096 B1 * 6/2003 Andrews et al. ..... 204/262

FOREIGN PATENT DOCUMENTS

WO WO 98/42617 10/1998
WO WO 01/06038 A1 1/2001

* cited by examiner

*Primary Examiner*—Donald R. Valentine
(74) *Attorney, Agent, or Firm*—Cantor Colburn LLP

(57) ABSTRACT

A level sensing system includes a flow control device disposed in fluid communication with a liquid outlet stream of a hydrogen/water phase separation apparatus and a controller disposed in operable communication with the flow control device. The controller is configured to receive and quantify input data corresponding to a measure of the rate of generation of hydrogen gas from a proton exchange membrane electrolysis cell. A method of maintaining a liquid level in the hydrogen/water phase separation apparatus includes deriving the rate of generation of hydrogen gas from the electrolysis cell, transmitting a value corresponding to the rate of generation to the flow control device, and adjusting the flow rate of the liquid exiting the hydrogen/water phase separation apparatus correspondingly with the rate of generation of hydrogen gas.

18 Claims, 4 Drawing Sheets

PROTONIC RATE LEVEL SENSING DEVICE FOR AN ELECTROLYSIS CELL

CROSS REFERENCE TO RELATED APPLICATION

This application claims the benefits of U.S. Provisional Patent Application Serial No. 60/286,191 filed Apr. 24, 2001, the content of which is incorporated herein by reference in its entirety.

BACKGROUND

This disclosure relates to electrochemical cells, and, more particularly, to an apparatus and methods for sensing and controlling the liquid level in an electrolysis cell utilizing the protonic rate.

Electrochemical cells are energy conversion devices, usually classified as either electrolysis cells or fuel cells. Proton exchange membrane electrolysis cells can function as electrolysis cells by electrolytically decomposing water to produce hydrogen and oxygen gases. Referring to FIG. 1, a section of an anode feed electrolysis cell of the prior art is shown generally at 10 and is hereinafter referred to as "cell 10." Reactant water 12 is fed into cell 10 at an oxygen electrode (anode) 14 to form oxygen gas 16, electrons, and hydrogen ions (protons) 15. The chemical reaction is facilitated by the positive terminal of a power source 18 connected to anode 14 and the negative terminal of power source 18 connected to a hydrogen electrode (cathode) 20. Oxygen gas 16 and a first portion 22 of the water are discharged from cell 10, while protons 15 and a second portion 24 of the water migrate across a proton exchange membrane 26 to cathode 20. At cathode 20, hydrogen gas 28 is removed, generally through a gas delivery line. The removed hydrogen gas 28 is usable in a myriad of different applications. Second portion 24 of water is also removed from cathode 20.

Second portion 24 of water, which is rich in hydrogen, is recovered by a hydrogen/water phase separation apparatus (described below). The hydrogen/water phase separation apparatus allows the hydrogen entrained in second portion 24 of water to diffuse from the water and into the vapor phase above second portion 24 of water. The hydrogen is then recovered, and water is returned to the system to supplement reactant water 12. The hydrogen/water phase separation apparatus is of a limited volumetric capacity; therefore, second portion 24 of water accommodated therein oftentimes must be returned to the system before all of the entrained hydrogen gas can diffuse out of second portion 24 of water. In such a system, the level of water in the hydrogen/water phase separation apparatus has heretofore been sensed and controlled using conventional level sensing and controlling techniques.

The detection and control of the water level in the hydrogen/water phase separation apparatus involves the disposition of sensing equipment directly into either or both the liquid and the vapor phase above the liquid. One of the most common methods of detecting and controlling the liquid level in the hydrogen/water phase separation apparatus (or any other type of containment vessel) involves measuring the difference in static pressure between two fixed elevations, one of the fixed elevations being in the vapor phase above the liquid and the other fixed elevation being below the liquid surface. The differential pressure between the two fixed elevations is directly related to the liquid level in the hydrogen/water phase separation apparatus. One of the problems associated with such a method derives from the buildup of condensation in the line from which the static pressure in the vapor phase is measured. If the line fills up with condensate, the differential pressure will be zero even if the liquid level is near the fixed elevation in the vapor phase. Such a false reading may be interpreted by an operator as indicative of the vessel being empty. Other methods of detecting and controlling liquid and vapor levels pose similar problems.

When equipment required for the sensing and control of liquid levels is installed such that the liquid levels are at least partially dependent upon the pressure of the system into which they are incorporated, cautionary measures must generally be incorporated into the process to ensure that all of the equipment remains fully functional. Such cautionary measures oftentimes require ongoing maintenance in order to allow for the maximum operability of the equipment with as little downtime as possible. Ongoing maintenance, however, generally adversely affects the overall cost of the process.

While existing electrolysis cell systems are suitable for their intended purposes, there still remains a need for improvements, particularly regarding the management of the separation of the hydrogen gas from the water. Furthermore, a need exists for improved sensing and control of the level of the water in the hydrogen/water phase separation apparatus during the operation of the associated electrolysis cell system.

SUMMARY

A level sensing system for determining the level of a liquid in a hydrogen/water phase separation apparatus associated with an electrolysis cell comprises a flow control device disposed in fluid communication with a liquid outlet stream of the hydrogen/water phase separation apparatus and a controller disposed in operable communication with the flow control device. The controller is configured to receive and quantify input data corresponding to a measure of the rate of generation of hydrogen gas from the proton exchange membrane electrolysis cell.

A method of maintaining a level of a liquid in a hydrogen/water phase separation apparatus disposed in fluid communication with a proton exchange membrane electrolysis cell comprises deriving a rate of generation of hydrogen gas in a cell stack of the electrolysis cell, transmitting the rate of generation of the hydrogen gas to a flow control device, and adjusting the flow rate of the liquid exiting the hydrogen/water phase separation apparatus correspondingly with the rate of generation of hydrogen gas in the cell stack.

DETAILED DESCRIPTION

Disclosed herein is a novel configuration for an electrochemical cell that may be operated as an electrolysis cell. Also disclosed are methods for operating the cell. The electrolysis cell comprises a phase separation tank that includes a level sensing system that provides for the sensing and control of fluid levels in the separation tank in response to variations in the protonic rate of the electrolysis cell. The level sensing system includes a controller disposed in informational communication with a flow control device (e.g., a valve) and receives operator input parameters and evaluates the parameters to derive a protonic rate value in accordance with a protonic rate formula. The protonic rate value is quantified as an output signal and is utilized to control the flow control device, thereby adjusting the water level in the separation tank.

Although the disclosure below is described in relation to a proton exchange membrane electrochemical cell employing hydrogen, oxygen, and water, other types of electrochemical cells and/or electrolytes may be used, including, but not limited to, phosphoric acid and the like. Various reactants can also be used, including, but not limited to, hydrogen, bromine, oxygen, air, chlorine, and iodine. Upon the application of different reactants and/or different electrolytes, the flows and reactions change accordingly, as is commonly understood in relation to that particular type of electrochemical cell. Furthermore, while the discussion below is directed to an electrolysis cell, it should be understood that cathode feed electrolysis cells, fuel cells, and regenerative fuel cells are also within the scope of the embodiments disclosed.

Figure 2:
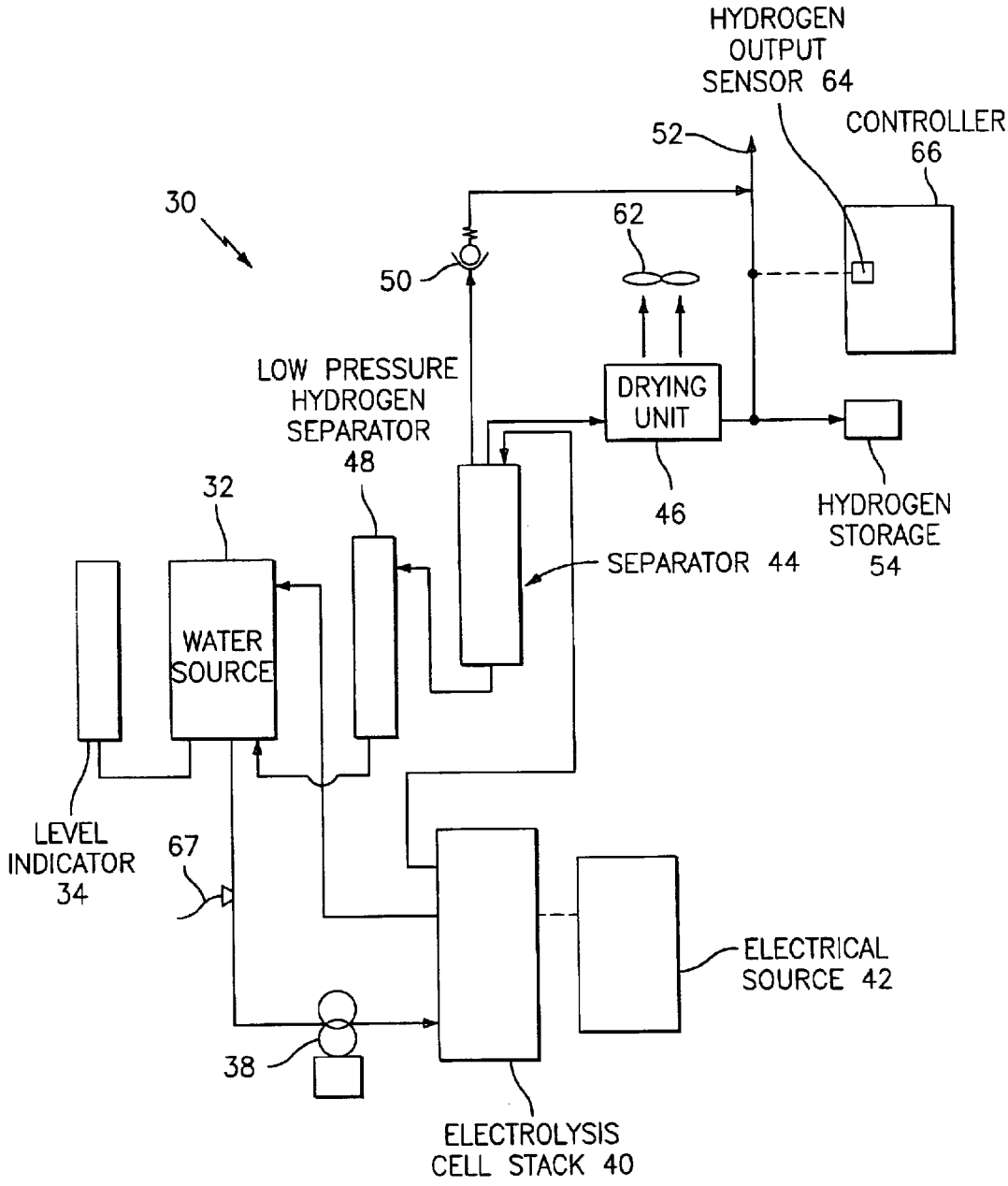
FIG. 2 is a schematic representation of a hydrogen generator into which an electrolysis cell may be incorporated.

Referring to FIG. 2, an exemplary embodiment of a hydrogen gas generator is an electrolysis cell system, which is shown at 30 and is hereinafter referred to as "generator 30." Generator 30 may be suitable for generating hydrogen for use as a fuel or for various other applications. Generator 30 includes a water-fed electrolysis cell capable of generating hydrogen gas from reactant water and is operatively coupled to a control system. The reactant water utilized by generator 30 is supplied from a water source 32 having a level indicator 34 operatively included therewith. The reactant water is pumped through a pump 38 into an electrolysis cell stack 40.

Water source 32 provides the fuel for generator 30 by supplying reactant water to the system. The reactant water utilized by generator 30 is stored in water source 32 and is fed by gravity or pumped through a supply line into cell stack 40. The supply line is preferably clear, plasticizer-free tubing. An electrical conductivity sensor 67 may be disposed within the supply line to monitor the electrical potential of the water, thereby determining its purity and ensuring its adequacy for use in generator 30.

Figure 1:
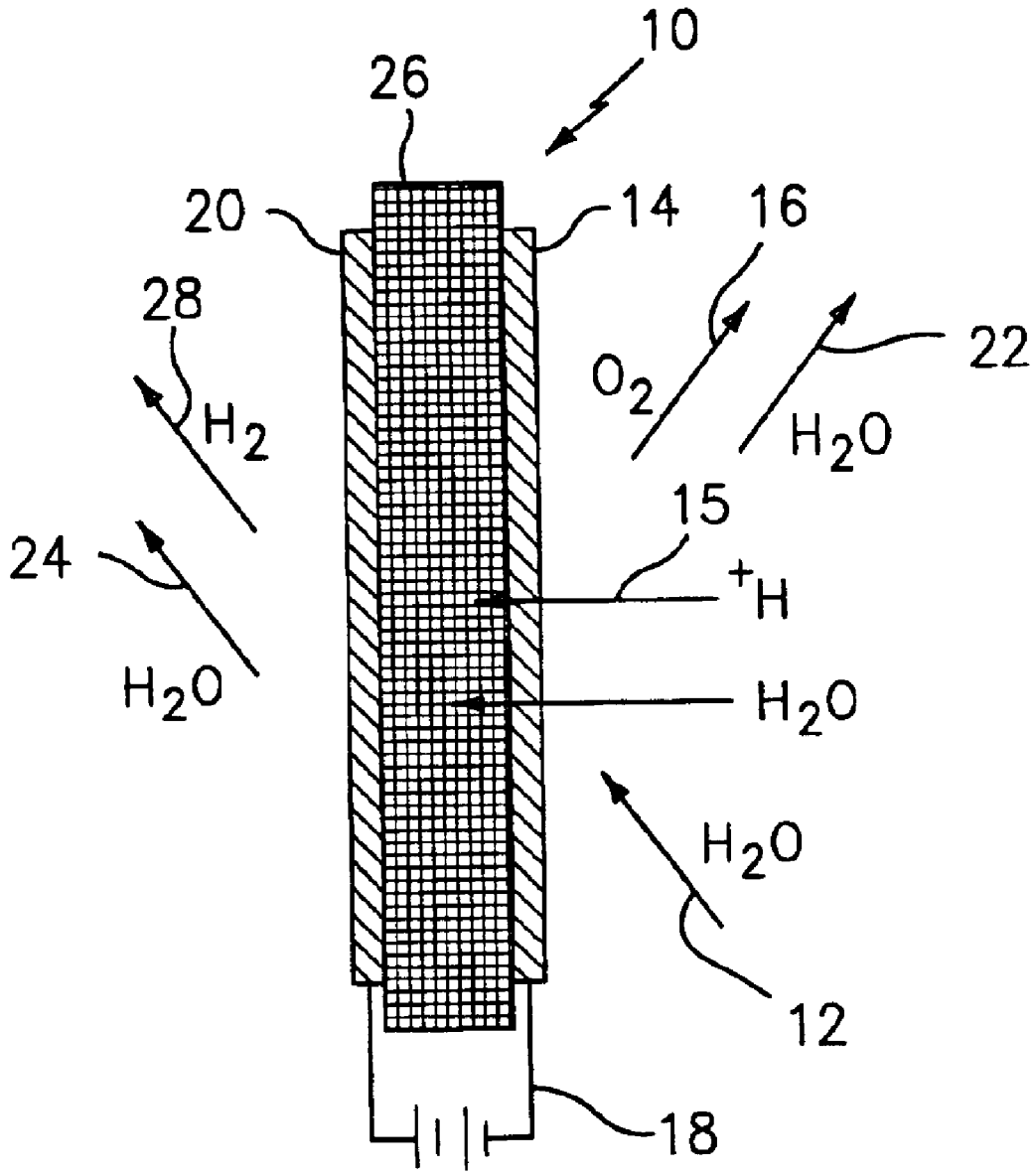
FIG. 1 (PRIOR ART)
FIG. 1 is a schematic representation of an anode feed electrolysis cell of the prior art.

Cell stack 40 comprises a plurality of cells similar to cell 10 described above with reference to FIG. 1 encapsulated within sealed structures (not shown). The reactant water is received by manifolds or other types of conduits (not shown) that are in fluid communication with the cell components. An electrical source 42 is connected across the anodes and cathodes of each cell within cell stack 40 to allow the water to disassociate. Oxygen and water exit cell stack 40 via a common stream and are ultimately returned to water source 32, whereby the water is recycled and the oxygen is vented to the atmosphere. The hydrogen stream, which contains water, exits cell stack 40 and is fed to a phase separation tank, which is a hydrogen/water phase separation apparatus shown generally at 44, hereinafter referred to as "separator 44," where the gas and liquid phases are separated. This hydrogen stream has a pressure that may be anywhere from about 1 pound per square inch (psi) up to about 20,000 psi. Preferably, the hydrogen stream is about 1 psi to about 10,000 psi with a pressure of about 100 psi to about 6,000 psi preferred, a pressure of about 1,500 psi to about 2,500 psi more preferred for some applications, and a pressure of about 100 psi to about 275 psi more preferred for other applications.

Some water is removed from the saturated hydrogen stream at separator 44. The removed water, with trace amounts of hydrogen entrained therein, may be returned to water source 32 through a low-pressure hydrogen separator 48. Low-pressure hydrogen separator 48 allows hydrogen to escape from the water stream due to the reduced pressure, and also recycles water to water source 32 at a lower pressure than the water exiting separator 44. Separator 44 may also include a release 50, which may be a relief valve, to rapidly purge hydrogen to a hydrogen vent 52 when the pressure or pressure differential exceeds a predetermined limit.

The hydrogen gas exiting separator 44 is dried at a drying unit 46, which may be, for example, a diffuser, a pressure swing absorber, desiccant, or the like. The hydrogen from drying unit 46 is fed to a hydrogen storage 54. Additionally, a ventilation system 62 may be provided to assist in venting system gases when necessary.

A hydrogen output sensor 64 is incorporated into generator 30. Hydrogen output sensor 64 may be a pressure transducer that converts the gas pressure within the hydrogen line to a voltage or current value for measurement. However, hydrogen output sensor 64 can be any suitable output sensor other than a pressure transducer, including, but not limited to, a flow rate sensor, a mass flow sensor, or any other quantitative sensing device. Hydrogen output sensor 64 is interfaced with a controller 66, which is capable of converting the voltage or current value into a pressure reading. Furthermore, a display means (not shown) may be disposed in operable communication with hydrogen output sensor 64 to provide a reading of the pressure, for example, at the location of hydrogen output sensor 64 on the hydrogen line. Controller 66 may be any suitable gas output controller, such as an analog circuit or a digital microprocessor.

Figure 3:
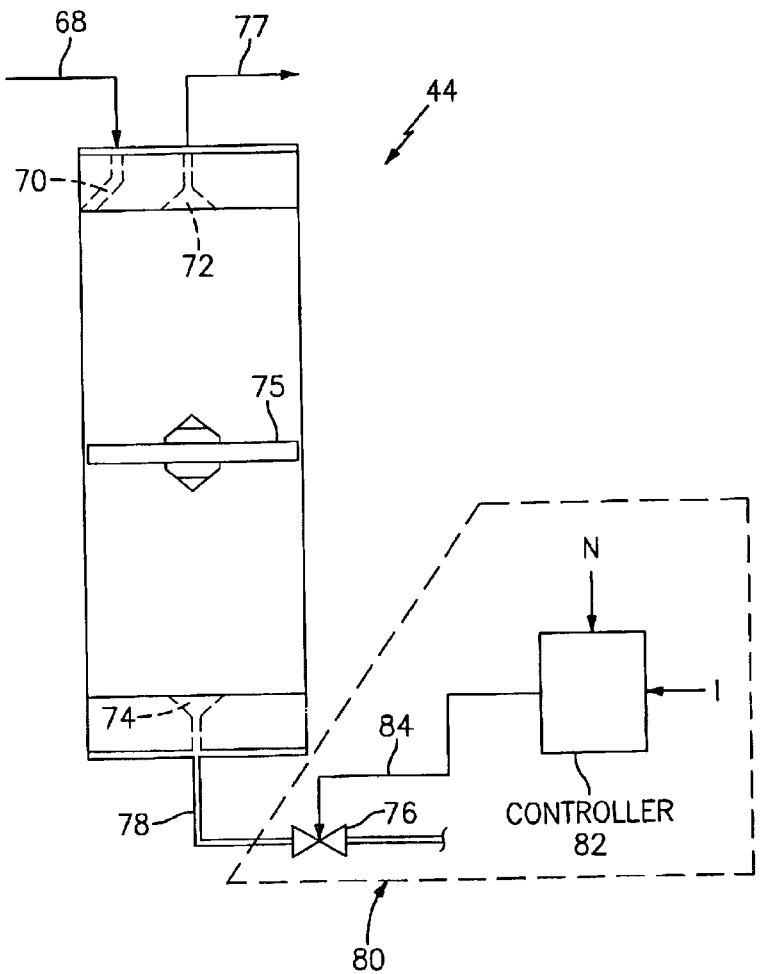
FIG. 3 is a schematic representation of a hydrogen/water phase separation apparatus in operable communication with a level sensing system.

Referring to FIG. 3, separator 44 is shown generally and in greater detail. Separator 44 is configured to receive water, which is hereinafter referred to as a water inlet stream 68, from the cathode of the cell stack. Water inlet stream 68 is generally rich in hydrogen gas and is held in separator 44 to allow the hydrogen gas entrained in the water to separate from the water, thereby facilitating its recovery. Separator 44 comprises a water inlet 70 through which water inlet stream 68 is received, a vapor outlet 72, a liquid outlet 74, a float 75, and a level sensing system, shown generally at 80. Liquid outlet 74 is in fluid communication with a flow control device 76 through a liquid outlet stream 78. The body portion of separator 44 may be substantially cylindrical in shape.

Water inlet 70 may be positioned in an upper portion of separator 44 such that as water inlet stream 68 is received into separator 44, the water entrained with hydrogen gas flows to a lower portion of separator 44. Water inlet 70 may also be configured and positioned such that water inlet stream 68 flows into separator 44 along an inner wall of separator 44 in order to minimize splashing of the water in separator 44, thereby minimizing further entrainment of the hydrogen in the water.

Vapor outlet 72 is located in the upper portion of separator 44 proximate water inlet 70 to allow for the removal of a hydrogen gas stream 77. Vapor outlet 72 is configured and dimensioned to receive float 75 therein to effectively prevent water from entering the vapor outlet stream if separator 44 becomes flooded with water.

Liquid outlet 74 is preferably located in the lower portion of separator 44 to allow for the removal of liquid outlet stream 78 from separator 44 through a conduit. Water from liquid outlet stream 78 may be returned to the water source for continued processing in the cell stack. Liquid outlet 74 is configured and dimensioned to receive float 75 and to effectively prevent hydrogen gas from being forced into liquid outlet stream 78 in the event that separator 44 contains no liquid.

Float 75 is loosely positioned within the body of separator 44. The buoyancy of float 75 enables float 75 to translate between the upper and lower portions of the cylindrical body of separator 44 as the level of water in separator 44 varies. Float 75 is molded or otherwise formed into a shape having outer dimensions that are conducive to the uninhibited translation of float 75 along the cylindrical body of separator 44. The shape and outer dimensions of float 75 may be complementary to the shape and inner dimensions of the cylindrical body of separator 44.

Level sensing system 80 (hereinafter referred to as "system 80") is incorporated into separator 44 in order to determine the water level therein through the position of interfaces of the various liquid and gas phases of the fluids. System 80 provides for the sensing and control of fluid levels in separator 44 in response to the variations in the protonic rate of the electrolysis cell. The protonic rate is a measure of the rate of generation of hydrogen gas produced by the cell stack and is a function of the number of theoretical individual cells and the electrical current supplied to the cell stack. The protonic rate can be expressed by the formula $$\mathrm{Rate}_p = CIN$$

where $\mathrm{Rate}_p$ is the protonic rate, I is the value of the electrical current, N is the number of theoretical individual cells, and C is a constant. By configuring system 80 to respond to the protonic rate $\mathrm{Rate}_p$, the rate of generation of hydrogen gas in the cell stack can be monitored and compared to the flow rate of liquid outlet stream 78. Comparison of the rate of hydrogen generation and the flow rate of liquid outlet stream 78 allows for a material balance to be made on separator 44, thereby enabling the level of liquid in separator 44 to be ascertained and maintained at a selected level.

System 80 comprises a controller 82 disposed in informational communication with flow control device 76, which may be a solenoid valve, a proportional control valve, or any other suitable device. Controller 82 is configured to receive various operator input parameters including, but not being limited to, the number of theoretical individual cells N in the electrolysis cell and the constant value C. Controller 82 is also configured to receive input parameters from the electrolysis cell itself, particularly the value of the electrical current I. Electrical current I is derived from the cell stack operating current through a shunt or any other type of current sensing device. Electrical current I is typically expressed in units of amperes; however, electrical current I can alternately be expressed in other units (e.g., milliamperes) upon the proper reconfiguration of software (not shown) that provides the operating basis for controller 82.

Upon evaluation of the input parameters, controller 82 derives the protonic rate value $\mathrm{Rate}_p$ in accordance with the protonic rate formula. Protonic rate value $\mathrm{Rate}_p$ is quantified by controller 82 and is transmitted to flow control device 76 in the form of an output control signal 84. Output control signal 84 is a pulse width modulated (PWM) signal that produces a response that actuates flow control device 76. Because electrical current I from the cell stack is variable, output control signal 84 varies accordingly to either open or close flow control device 76 in varying degrees, thereby adjusting the water level in separator 44.

Figure 4:
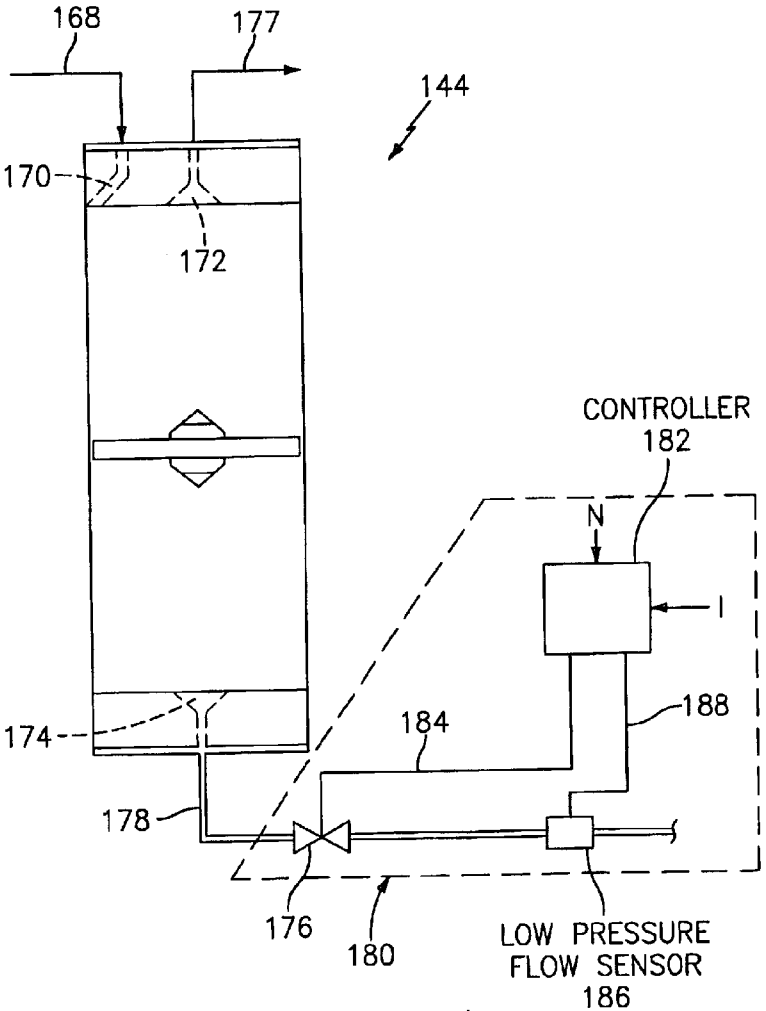
FIG. 4 is a schematic representation of a hydrogen/water phase separation apparatus in operable communication with a level sensing system having a low-pressure flow sensor incorporated therein.

Flow control device 76 may be configured in various manners depending upon the level of control desired. Referring now to FIG. 4, a separator, shown generally at 144, is used in conjunction with a level sensing system, shown generally at 180. Separator 144 is similar to separator 44 as shown in FIG. 2 and includes a water inlet 170 through which a water inlet stream 168 is received and a vapor outlet 172 through which a hydrogen gas stream 177 is expelled. Level sensing system 180, however, includes a low pressure flow sensor 186 disposed in a liquid outlet stream 178, thereby providing level sensing system 180 with enhanced control capabilities. Low pressure flow sensor 186, although depicted as being disposed downstream of a flow control device 176, may instead be disposed between a liquid outlet 174 and flow control device 176. Low pressure flow sensor 186 is in informational communication with a controller 182 of level sensing system 180 and is configured to receive fluid flow parameters characteristic of liquid outlet stream 178. The fluid flow parameters of liquid outlet stream 178 are evaluated in conjunction with protonic rate (defined as a function of the electrical current I and the number of theoretical cell plates N) of the electrolysis cell into which level sensing system 180 is incorporated. The fluid flow parameters are transmitted back to controller 182 as feedback data 188, thereby providing closed loop control to level sensing system 180. Feedback data 188 is evaluated and used to provide enhanced control of flow control device 176 via an output control signal 184 to control the level of liquid in separator 144.

Figure 5:
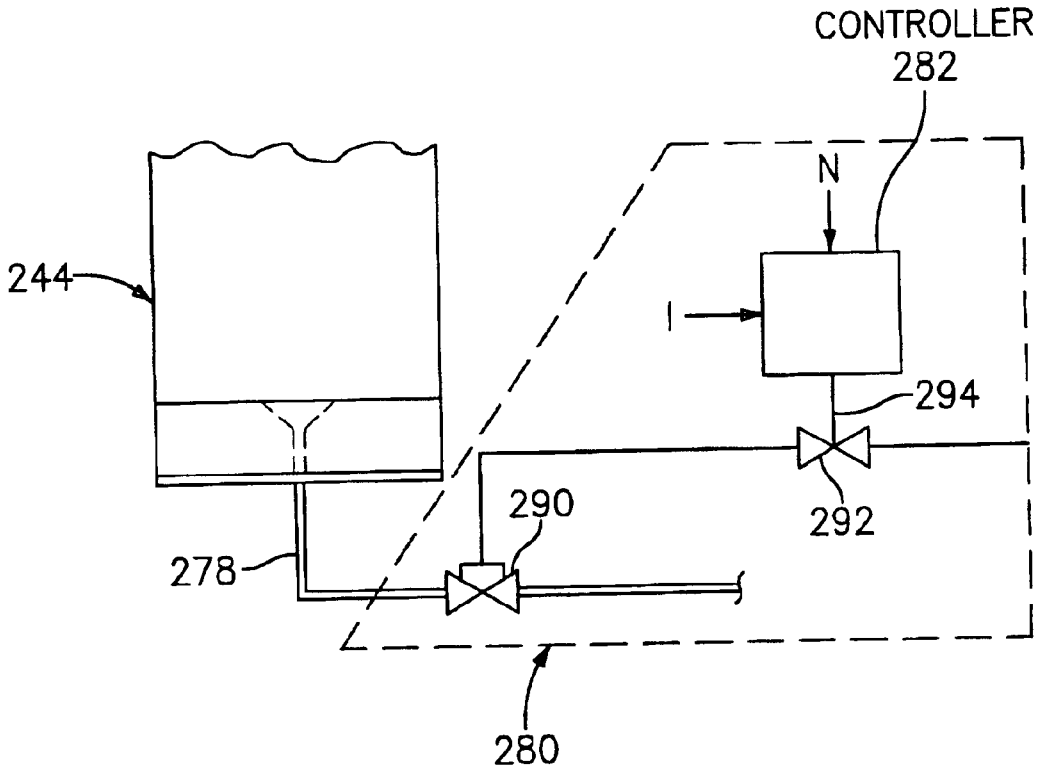
FIG. 5 is a schematic representation of a hydrogen/water phase separation apparatus in operable communication with a level sensing system having a dome loaded pressure regulator and a control valve.

Referring now to FIG. 5, control of a level sensing system 280 for a separator 244 may be further enhanced by incorporating a dome loaded pressure regulating flow control device 290 into a liquid outlet stream 278. Dome loaded pressure regulating flow control device 290 utilizes a fluid (not shown) disposed within the structure thereof to bias a spring-loaded diaphragm against a sealing surface. The internal architecture of dome loaded pressure regulating flow control device 290 enables fluid flow therethrough to be substantially unaffected by the presence of multiple phases of liquid outlet stream 278. In such an instance, variations in the flow rate of liquid outlet stream 278 are virtually transparent to an operator of level sensing system 280. Control of dome loaded pressure regulating flow control device 290 is effectuated through a control valve 292 maintained in communication therewith. Control valve 292 receives a PWM control signal 294 from a controller 282, which in turn calculates the protonic rate of the electrolysis cell into which level-sensing system 280 is incorporated from parameters such as the electrical current I and the number of theoretical cell plates N. Control valve 292 may be powered by air or hydrogen gas from the electrolysis cell.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A hydrogen gas generator, comprising:

a proton exchange membrane electrolysis cell; and a phase separation apparatus disposed in fluid communication with the proton exchange membrane electrolysis cell, the phase separation apparatus comprising;

a flow control device; and a level sensing system disposed in operable communication with the flow control device, the level sensing system being configured to adjust a liquid effluent flow rate through the flow control device in response to a measure of a rate of generation of hydrogen gas in a cell stack of the proton exchange membrane electrolysis cell.

2. The hydrogen gas generator of claim 1 further comprising a water source in fluid communication with the proton exchange membrane electrolysis cell.

3. The hydrogen gas generator of claim 2 wherein the water source continuously feeds the proton exchange membrane electrolysis cell.

4. The hydrogen gas generator of claim 1 wherein the phase separation apparatus further comprises a hydrogen gas outlet.

5. A level sensing system for a hydrogen/water phase separation apparatus disposed in fluid communication with a proton exchange membrane electrolysis cell, the hydrogen/water phase separation apparatus comprising:

a flow control device disposed in fluid communication with a liquid outlet stream of the hydrogen/water phase separation apparatus; and a controller disposed in operable communication with the flow control device, the controller being configured to receive and quantify input data corresponding to a measure of the rate of generation of hydrogen gas from the proton exchange membrane electrolysis cell.

6. The level sensing system of claim 5 wherein the operable communication between the controller and the flow control device is effectuated through a pulse width modulated signal transmitted from the controller to the flow control device.

7. The level sensing system of claim 5 wherein the input data corresponding to a measure of the rate of generation of hydrogen gas from the proton exchange membrane electrolysis cell comprises:

a number of theoretical individual cells of the proton exchange membrane electrolysis cell; and a value of an electrical operating current of the proton exchange membrane electrolysis cell.

8. The level sensing system of claim 5 wherein the rate of generation of hydrogen gas from the proton exchange membrane electrolysis cell is defined by the relationship $$\mathrm{Rate}_p = CIN$$

where C is a constant, I is a value of an electrical current, and N is a number of theoretical individual cells of the proton exchange membrane electrolysis cell.

9. The level sensing system of claim 5 wherein the controller provides proportional control to the flow control device.

10. The level sensing system of claim 5 further comprising a low pressure flow sensor disposed in fluid communication with the liquid outlet stream of the hydrogen/water phase separation apparatus and in informational communication with the controller.

11. The level sensing system of claim 10 wherein the input data corresponding to a measure of the rate of generation of hydrogen gas from the proton exchange membrane electrolysis cell comprises:

a number of theoretical individual cells of the proton exchange membrane electrolysis cell;

a value of an electrical operating current of the proton exchange membrane electrolysis cell; and input data from the low pressure flow sensor.

12. The level sensing system of claim 5 wherein the flow control device is a dome loaded pressure regulating flow control device.

13. The level sensing system of claim 12 wherein a control valve is disposed in informational communication with the flow control device and the controller.

14. The level sensing system of claim 13 wherein the control valve is powered by air pressure.

15. The level sensing system of claim 13 wherein the control valve is powered by hydrogen gas.

16. A method of maintaining a level of a liquid in a hydrogen/water phase separation apparatus disposed in fluid communication with a proton exchange membrane electrolysis cell, the method comprising:

deriving a rate of generation of hydrogen gas in a cell stack of the proton exchange membrane electrolysis cell;

transmitting the rate of generation of the hydrogen gas to a flow control device; and adjusting a flow rate of the liquid exiting the hydrogen/water phase separation apparatus correspondingly with the rate of generation of hydrogen gas in the cell stack.

17. The method of claim 16 wherein the deriving of the rate of generation of hydrogen gas comprises:

receiving an electrical current value from the cell stack;

receiving an input value corresponding to a number of theoretical individual cells of the cell stack; and calculating a value corresponding to the rate of generation of hydrogen gas in accordance with a mathematical operation.

18. The method of claim 16 wherein the adjusting of the flow rate of the liquid exiting the phase separator comprises manipulating the flow control device in accordance with a value obtained from the deriving of the rate of generation of hydrogen gas in the cell stack.

* * * * *